US007204325B2

(12) United States Patent
Song et al.

(10) Patent No.: US 7,204,325 B2
(45) Date of Patent: Apr. 17, 2007

(54) SPRING MECHANISM FOR DOWNHOLE STEERING TOOL BLADES

(75) Inventors: Haoshi Song, Sugar Land, TX (US); William C. Paluch, Jersey Village, TX (US); Michael J. Moody, Katy, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 274 days.

(21) Appl. No.: 11/061,339

(22) Filed: Feb. 18, 2005

(65) Prior Publication Data

US 2006/0185902 A1 Aug. 24, 2006

(51) Int. Cl.
*E21B 7/08* (2006.01)

(52) U.S. Cl. ..... 175/61; 175/73; 175/230; 175/325.1

(58) Field of Classification Search ..... 175/61, 175/73, 230, 325.1–325.7; 166/206, 212, 166/243

See application file for complete search history.

(56) References Cited

U.S. PATENT DOCUMENTS

| | | | | |
|---|---|---|---|---|
| 2,373,880 A | | 4/1945 | Driscoll | |
| 2,603,163 A | | 7/1952 | Nixon | |
| 2,874,783 A | | 2/1959 | Haines | |
| 2,880,805 A | | 4/1959 | Nelson et al. | |
| 2,915,011 A | | 12/1959 | Hamill | |
| 3,126,971 A | * | 3/1964 | Kellner | 175/230 |
| 3,196,959 A | * | 7/1965 | Kammerer | 175/73 |
| 4,407,374 A | | 10/1983 | Wallussek et al. | |
| 4,416,339 A | | 11/1983 | Baker et al. | |
| 4,463,814 A | | 8/1984 | Horstmeyer et al. | |
| 4,844,178 A | | 7/1989 | Cendre et al. | |
| 4,947,944 A | | 8/1990 | Coltman et al. | |
| 4,957,173 A | | 9/1990 | Kinnan | |
| 5,070,950 A | | 12/1991 | Cendre et al. | |
| 5,232,058 A | * | 8/1993 | Morin et al. | 175/73 |
| 5,265,684 A | * | 11/1993 | Rosenhauch | 175/61 |
| 5,603,386 A | | 2/1997 | Webster | |
| 5,797,453 A | | 8/1998 | Hisaw | |
| 5,941,323 A | | 8/1999 | Warren | |
| 6,148,933 A | | 11/2000 | Hay et al. | |
| 6,158,529 A | | 12/2000 | Dorel | |
| 6,290,003 B1 | | 9/2001 | Russell | |
| 6,427,783 B2 | | 8/2002 | Krueger et al. | |
| 6,761,232 B2 | | 7/2004 | Moody et al. | |

FOREIGN PATENT DOCUMENTS

| | | |
|---|---|---|
| EP | 1174582 A3 | 1/2002 |
| WO | WO-01-51761 A1 | 7/2001 |
| WO | WO-03-097989 A1 | 11/2003 |

* cited by examiner

*Primary Examiner*—Kenneth Thompson

(57) ABSTRACT

A steering tool for use in a well bore is disclosed. The tool includes at least one extendable and retractable blade deployed thereon. The blade is elastically spring biased radially inwards towards the tool such that upon removal of an actuating force, the blade retracts. In exemplary embodiments, the blade includes at least one spring-like, elastically deformable member disposed to elastically spring bias the blade. The spring-like member may include first and second elongated leg portions located on opposing sides of a sprung hairpin portion. Tools embodying this invention may be advantageous for small diameter applications.

21 Claims, 7 Drawing Sheets

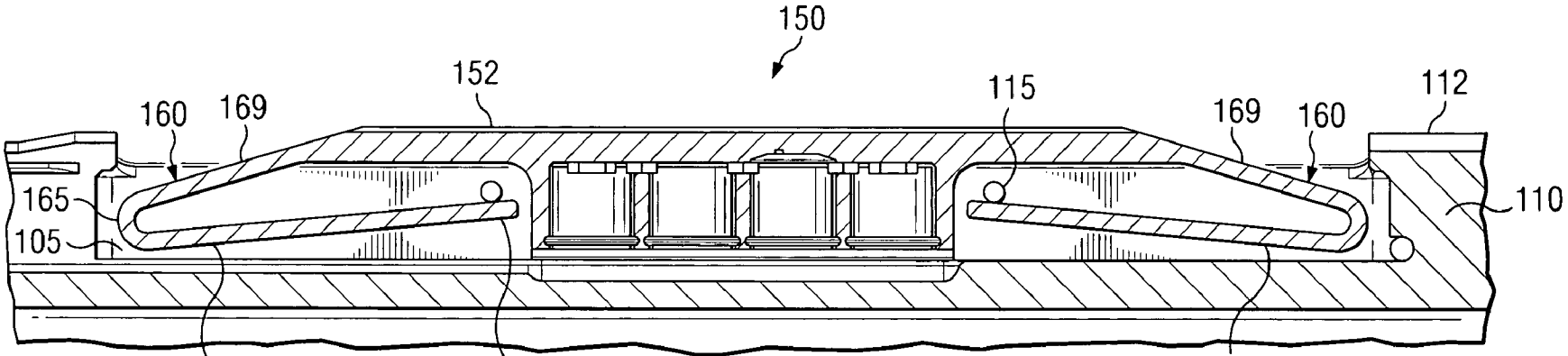
FIG. 4A
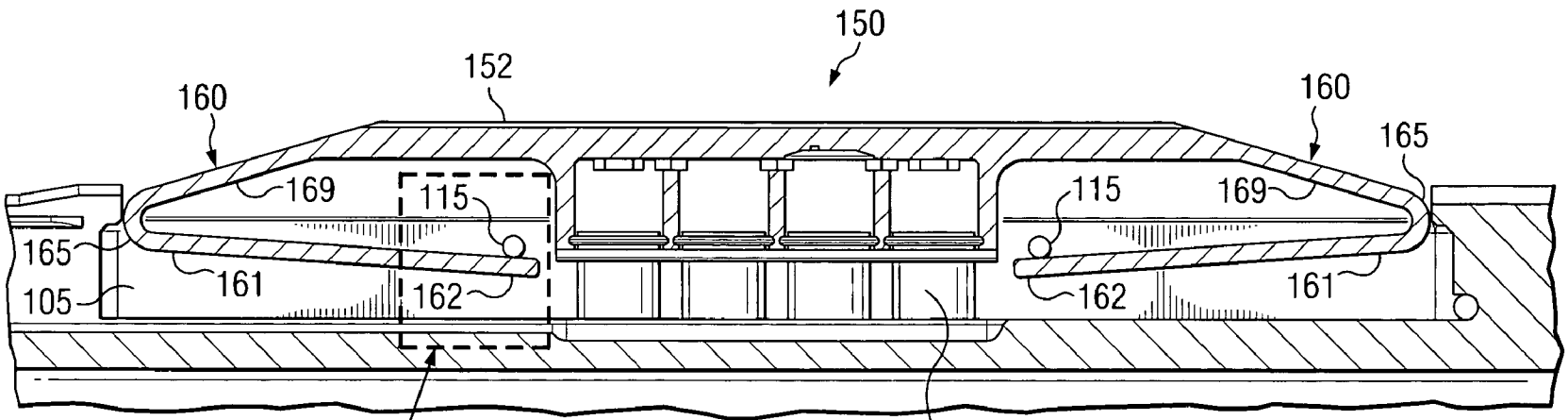
FIG. 4B
FIG. 4C

SPRING MECHANISM FOR DOWNHOLE STEERING TOOL BLADES

FIELD OF THE INVENTION

The present invention relates generally to downhole tools utilized in the drilling of oil and gas wells. More specifically, this invention relates to a downhole steering tool including one or more extendable and retractable blades that are elastically spring biased radially inwards towards the tool body.

BACKGROUND OF THE INVENTION

During the drilling, testing, and completion of oil and gas wells numerous downhole tools are used that utilize radially protruding members (blades) that contact the well bore wall to center, position, stabilize, and/or steer the tool in the well bore. For example, in directional drilling applications, which are commonly used to more fully exploit hydrocarbon reservoirs, drill assemblies are typically utilized that include a plurality of independently operable blades to apply force on the well bore wall during drilling to maintain the drill bit along a prescribed path and to alter the drilling direction. Such blades are typically disposed on the outer periphery of the drilling assembly body or on a non-rotating sleeve disposed around a rotating drive shaft. One or more of the blades may be moved in a radial direction, e.g., using electrical or hydraulic devices, to apply force on the well bore wall in order to steer the drill bit outward from the central axis of the well bore.

Prior art downhole tools, such as the Autotrak® steering tool (available from Baker Hughes Incorporated, Houston, Tex.), typically utilize blades that are coupled to the tool body at a hinge. Alternatively, such as in the steering tool disclosed by Webster (U.S. Pat. No. 5,603,386), the blades are not directly coupled to the tool body, but rather to one or more actuators that are in turn mounted on the tool body.

Downhole tools that include blades typically are further capable of retracting the members inward towards the tool body. Such retraction may be required, for example, at the end of an operation, such as a drilling or survey operation, to allow the tool to be withdrawn from the well bore without becoming lodged therein or damaging the blades. One drawback with the above described prior art downhole tools, is that they tend to require complex mechanical and/or pneumatic/hydraulic devices for extending and retracting the blades. Such mechanisms for extending and retracting typically have a number of interoperable moving parts, whose complexity tends to inherently reduce the reliability of the downhole tool. Moreover, such mechanisms are not always suitable for smaller diameter tools.

U.S. Pat. No. 6,761,232 to Moody et al., which is commonly assigned with the present application and is hereinafter referred to as the Moody patent, discloses a downhole steering tool including one or more elastically spring biased blades. The blades each include a moveable end that is free to move relative to the tool body and that may be extended outwards from the tool via an actuation module. Upon de-actuation, the elastically spring biased blades retract. The blades also include a fixed end, which is mechanically connected to or integral with the tool body. While the use of such elastically spring biased blades may be serviceable for some applications, there is room for yet further improvement. For example, such blades may be prone to lateral translation or tilting in response to stress build-up in the blade.

Therefore, there exists a need for downhole steering tools including an improved mechanism for extending and retracting the blades, in particular one that is suitable for small diameter tools. The also exists a need for improved blade controllability and stability for such tools.

SUMMARY OF THE INVENTION

The present invention addresses one or more of the above-described drawbacks of prior art steering tools. Aspects of this invention include a downhole steering tool having at least one extendable and retractable blade disposed to displace the tool from the central axis of the borehole. An actuation module is disposed to extend the blade radially outward from the tool into contact with a borehole wall. The blade is elastically spring biased radially inwards towards the tool such that upon removal of the actuating force, the blade retracts. The blade includes (or is coupled to) at least one spring like, elastically deformable member (referred to herein equivalently as either a sprung member or a sprung end) disposed to elastically spring bias the blade. In one exemplary embodiment, the sprung member includes first and second elongated leg portions located on opposing sides of a sprung hairpin portion, the hairpin portion being elastically spring biased to close the legs. In another exemplary embodiment, the sprung member is deployed in floating contact with the tool body such that it is restrained from outward radial motion relative to the tool body, but is substantially free to pivot about a portion of the tool body.

Exemplary embodiments of the present invention advantageously provide several technical advantages. Various embodiments of this invention provide a downhole steering tool including a single mechanism for extending and retracting a blade. Tools embodying this invention may thus provide improved reliability as a result of a reduction in complexity over the prior art. Moreover, the single mechanism for extending and retracting is advantageous for small diameter steering tools. Embodiments of this invention also tend to minimize lateral (side-to-side) movement and tilting (rotation) of the blade and thereby advantageously provide for improved blade controllability and stability.

In one exemplary aspect the present invention includes a downhole steering tool. The steering tool includes a steering tool body having an outer surface and at least one blade deployed in a recess on the outer surface of the tool body, the blade being configured to displace between radially opposed retracted and extended positions. The steering tool further includes at least one hairpin sprung member disposed to elastically spring bias the blade radially inward towards the retracted position. The hairpin sprung member includes first and second leg portions located on opposing sides of a sprung hairpin portion. The first leg portion is engaged with the blade and the second leg portion is engaged with the tool body. The steering tool still further includes at least one actuation module disposed, upon actuation, to extend the blade radially outward from the tool body towards the extended position. The actuation is disposed to open the hairpin sprung member against its elastic spring bias. The elastic spring bias is disposed to close the hairpin sprung member and thereby retract the blade radially inward towards the retracted position upon deactuation of the actuation module.

In another exemplary aspect this invention includes a downhole steering tool. The steering tool includes a tool body having an outer surface and at least one blade deployed in a recess on the outer surface of the tool body, the blade being configured to displace between radially opposed retracted and extended positions. The blade includes first and second sprung ends. The sprung ends are located proximate to first and second longitudinally opposed ends of the blade and are disposed to elastically spring bias the blade radially inward towards the retracted position. Each of the sprung ends is in floating contact with the tool body, the floating contact substantially restraining a contact portion of the sprung end from translating radially outward relative to the tool body. The contact portion is further substantially free to pivot about a portion of the tool body. The steering tool further includes at least one actuation module disposed, upon actuation, to extend the blade radially outward from the tool body towards the extended position. The elastic spring bias is disposed to retract the blade radially inward towards the retracted position upon deactuation of the actuation module.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1A:
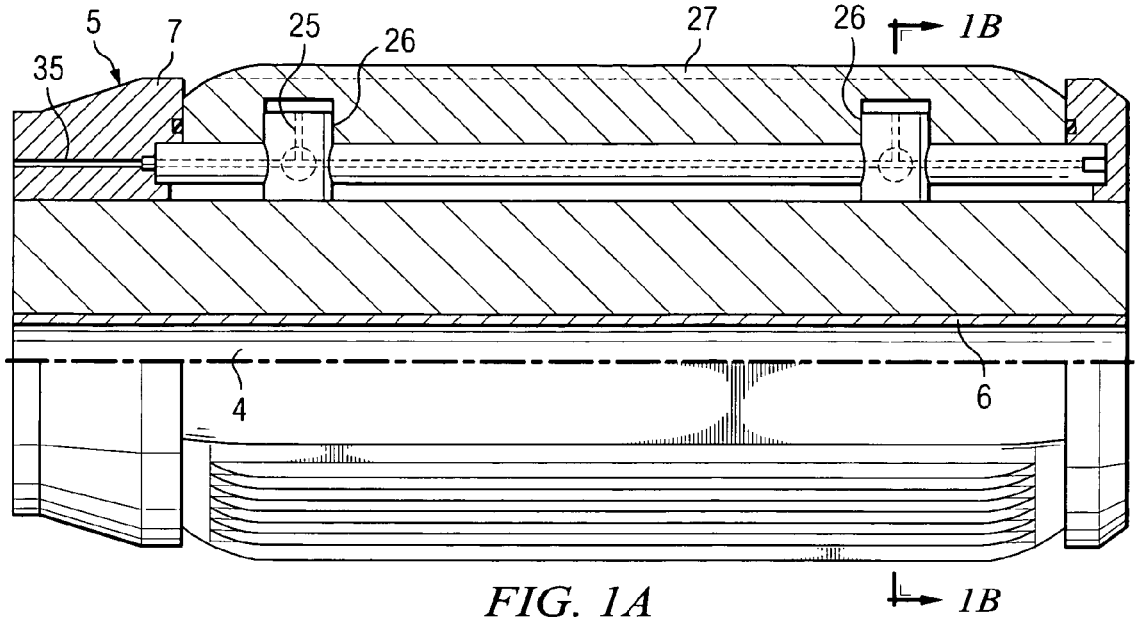
FIG. 1A (PRIOR ART)
FIG. 1A is a partial cross-sectional longitudinal view of a portion of a prior art downhole steering tool for directional drilling.
Figure 1B:
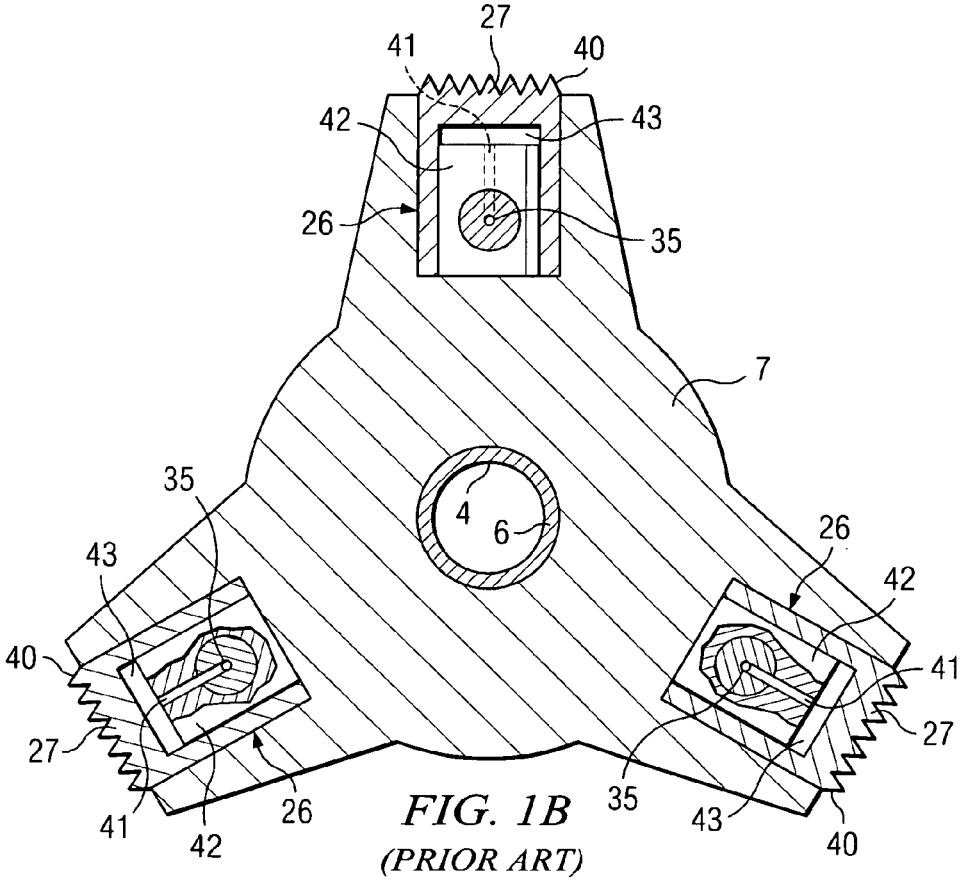
FIG. 1B (PRIOR ART)
FIG. 1B is a cross-sectional view of FIG. 1A.

Referring now to FIGS. 1A and 1B, a portion of one example of a prior art steering tool for directional drilling is illustrated (FIGS. 1A and 1B abstracted from U.S. Pat. No. 5,603,386, hereafter referred to as the Webster patent). The Webster patent discloses a steering/stabilizing tool including a body portion 5 having a central bore 4. The tool further includes a number of blades 27 (of which only one is shown in FIG. 1A) disposed circumferentially around an inner sleeve 6 extending through an outer sleeve 7. In a preferred embodiment of the Webster patent, three parallel blades 27 are disposed equi-angularly around the circumference of the tool (see FIG. 1B). A valve body (not shown) is operated by hydraulic switches, which act on instructions from a control unit to open and close hydraulic lines 35 which communicate with the blades 27.

Piston assemblies 26 (or other suitable equivalents) are provided for extending and retracting the blades 27. A potentiometer 25, or an ultrasonic measuring device, or other suitable measuring device, is provided for each piston assembly to calculate the displacement of each of the blades 27 from the retracted position. Each of the blades 27 may be independently extendible and retractable to retain the steering/stabilizing tool at the desired eccentricity relative to the central axis of the well bore.

The piston assemblies 26 and blades 27 of a preferred embodiment of the Webster patent are shown more clearly in FIG. 1B. The preferred arrangement of the three parallel blades 27 is shown, and the blades 27 may be provided with longitudinally serrated outer edges 40 which may enable the tool to grip the edges of the well bore more effectively. Each hydraulic line 35 communicates with a blade 27 via a port 41 through the piston 42 in each assembly 26. Thus, when hydraulic pressure changes are transmitted from the valve body (not shown) along a hydraulic line 35, these pressure changes are passed through port 41 and into chamber 43 between a piston 42 and the blade 27. The piston 42 remains stationary, and the blade 27 is extended or retracted in response to these pressure changes.

It will be understood that the steering tool disclosed in the Webster patent is characteristic of other tools of the prior art providing blades, in that it requires a complex mechanism for extending and retracting the blades. The Webster patent, for example, discloses a complex hybrid mechanical/hydraulic mechanism, the mechanism having many interoperable moving parts and including a hydraulic circuit including eight solenoids and nine check valves for controlling three blades. Such complex mechanisms for extending and retracting tend to reduce the reliability of the downhole tool. Further, increased complexity tends to increase both fabrication and maintenance costs.

Figure 2:
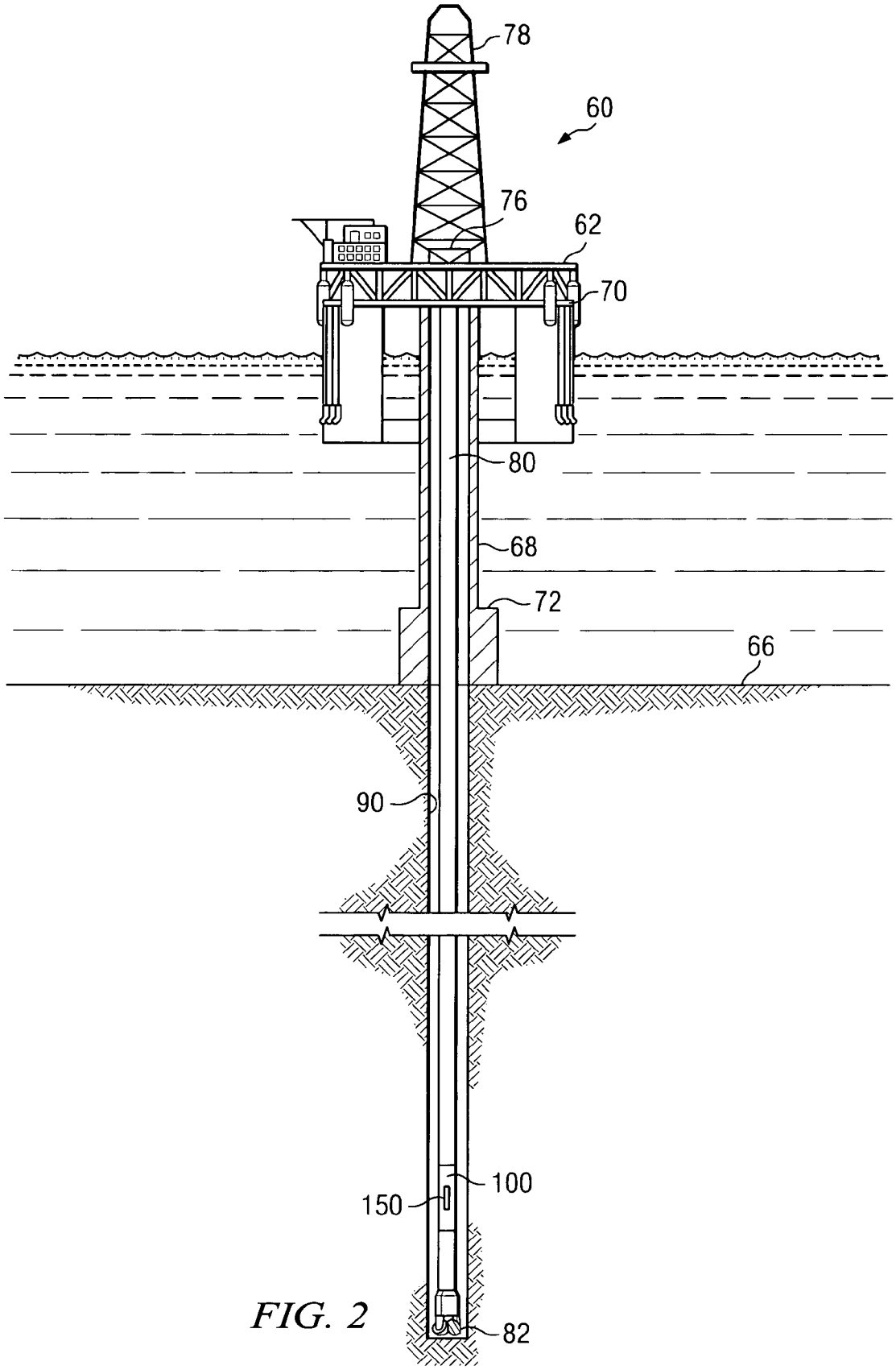
FIG. 2 depicts an offshore oil and/or gas drilling platform utilizing an exemplary steering tool embodiment of the present invention.

Referring now to FIGS. 2 through 8, exemplary embodiments of the present invention are illustrated. FIG. 2 schematically illustrates one exemplary embodiment of a downhole steering tool 100 according to this invention in use in an offshore oil and/or gas drilling assembly, generally denoted 60. In FIG. 2, a semisubmersible drilling platform 62 is positioned over an oil or gas formation (not shown) disposed below the sea floor 66. A subsea conduit 68 extends from deck 70 of platform 62 to a wellhead installation 72. The platform may include a derrick 76 and a hoisting apparatus 78 for raising and lowering the drill string 80. Drill string 80, as shown, extends into borehole 90 and includes a drill bit assembly 82 and steering tool 100 deployed thereon. Tool 100 includes one or more blades 150 disposed to displace the drill string 80 from the central axis of the well bore and thus change the drilling direction (as described in more detail below). Drill string 80 may further include a downhole drilling motor, a mud pulse telemetry system, and one or more sensors, such as LWD and/or MWD tools for sensing downhole characteristics of the borehole and the surrounding formation.

It will be understood by those of ordinary skill in the art that the deployment illustrated on FIG. 2 is merely exemplary for purposes of the invention set forth herein. It will be further understood that the downhole steering tool 100 of the present invention is not limited to use with a semisubmersible platform 62 as illustrated on FIG. 2. Steering tool 100 is equally well suited for use with any kind of subterranean drilling operation, either offshore or onshore.

Figure 3:
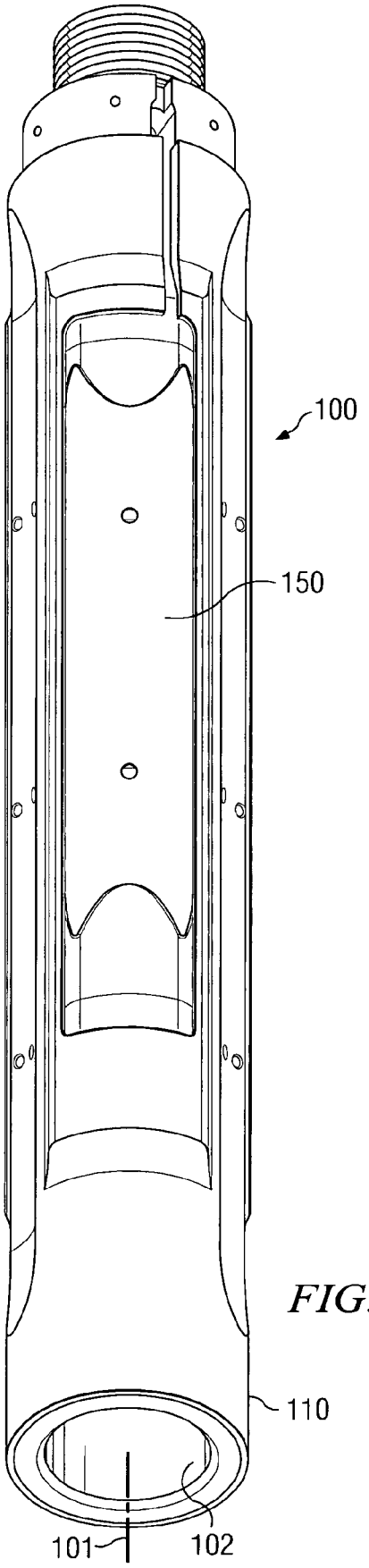
FIG. 3 is a perspective view of the steering tool shown on FIG. 2.

Turning now to FIG. 3, one exemplary embodiment of downhole steering tool 100 from FIG. 2 is illustrated in perspective view. In the exemplary embodiment shown, steering tool 100 is substantially cylindrical, having a through bore 102 and being largely symmetrical about longitudinal axis 101. Steering tool 100 may be configured, for example, for coupling to a drill bit (e.g., drill bit assembly 82 shown on FIG. 2). The steering tool 100 further includes a tool body 110 and at least one blade 150 deployed, for example, in a recess 105 (shown, for example, on FIGS. 4A and 4B) in the tool body 110. In the exemplary embodiment shown, the tool body 110 is deployed about a rotating drive shaft (not shown on FIG. 3), which transfers torque to a drill bit. In such embodiments, tool body 110 tends to be substantially non-rotating with respect to the borehole when the blades 150 are engaged with the borehole wall. Steering tool 100 may thus incorporate one or more bearing assemblies that enable the tool body 110 and a rotational drive portion of the drill string (including the drive shaft) to rotate relative to one another. It will be understood that this invention is not limited to embodiments including non-rotating tool bodies.

A downhole steering tool 100 deploying this invention may further include sensors, timers, programmable processors, and the like (not shown) for sensing and/or controlling the relative positions of the blades 150. These may include substantially any devices known to those skilled in the art, such as those disclosed in the Webster patent or in U.S. Pat. No. 6,427,783 to Krueger et al. For example, these sensors and electronics may enable bore holes having a pre-programmed profile, such as a predetermined tool face and dogleg severity or a predetermined inclination and azimuth, to be drilled from the start to the end of a borehole section.

Exemplary embodiments of steering tool 100 include three blades 150 (only one of which is shown on FIG. 3) deployed substantially equi-angularly about the tool body 110. The blades 150 are typically independently controllable via independently controllable actuation modules (not shown on FIG. 3) and are disposed to extend radially outward from tool body 110 and to engage the borehole wall. In steering tool embodiments, the intent of such engagement with the borehole wall is to laterally offset the steering tool axis 101 from the borehole axis (i.e., away from the geometrical center of the borehole), which tends to alter an angle of approach of a drill bit and thereby change the drilling direction. The magnitude and direction of the offset may be directly controllable (e.g., by controlling the relative radial positions of the blades 150) or indirectly controllable (e.g., by controlling the force applied by each blade to the borehole wall). In general, increasing the magnitude of the offset (i.e., increasing the distance between the tool axis 101 and the borehole axis) tends to increase the curvature (dogleg severity) of the borehole upon subsequent drilling. Moreover, in a "push the bit" configuration, the direction (tool face) of subsequent drilling tends to be the same (or nearly the same depending, for example, upon local formation characteristics) as the direction of the offset between the tool axis 101 and the borehole axis. For example, in a push the bit configuration a steering tool offset at a tool face of about 90 degrees (relative to high side) tends steer the drill bit to the right upon subsequent drilling. The artisan of ordinary skill will readily recognize that in a "point the bit" configuration, the direction of subsequent drilling tends to be in the opposite direction as the tool face (i.e., to the left in the above example). It will be appreciated that the invention is not limited to the above described steering tool embodiments.

Referring now also to FIGS. 4A and 4B a portion of steering tool 100 is shown in cross section with blade 150 in fully retracted (FIG. 4A) and fully extended (FIG. 4B) positions. While shown only fully retracted and fully extended, it will be appreciated that the blade 150 may be partially extended in a controllable manner to substantially any position between the fully retracted and fully extended positions. The blade 150 is configured to extend radially outward from the tool body 110 (in a direction substantially perpendicular to longitudinal axis 101 shown on FIG. 3), for example, into contact with a borehole wall (as described above). In the retracted position, blade 150 is located in recess 105. Contact surface 152 of the blade 150 is approximately aligned with an outer surface 112 (the periphery) of the tool body 110 when the blade 150 is retracted. However, it will be appreciated that the invention is not limited in this regard. For example, blade 150 may be recessed further into the tool body 110 such that contact surface 152 is recessed relative to outer surface 112.

Steering tool 100 further includes at least one actuation module 180 disposed to urge blade 150 outward from the tool body 110. In order to extend the blade 150, the actuation module 180 exerts a radial force over a desired actuation distance. Actuation module 180 may include substantially any actuating device, such as an electric motor or screw drive, wedges, bladders, hydraulic or pneumatic cylinders (or pistons), and/or other devices known to those skilled in the art. Embodiments including hydraulic cylinders (such as shown on FIGS. 4A and 4B) tend to be particularly serviceable. As described in the Webster patent, the hydraulic cylinders may be controlled by hydraulic switches (not shown), which may act on instruction from a control module (not shown) to open and close various hydraulic lines. The hydraulic fluid may be pressurized by substantially any known system, for example, by an electric powered pump, a bladder, or a turbine driven by a flow of drilling fluid through the core of the tool. In one exemplary embodiment, one or more piston pumps pressurize the hydraulic fluid. The piston pumps may be mechanically actuated, for example, by a cam or a swash plate mounted on a rotating drive shaft. It will be understood that the invention is not limited in this regard.

In the exemplary embodiment shown on FIGS. 4A and 4B, blade 150 includes longitudinally opposed first and second hairpin sprung ends 160. When the blade 150 is extended (either fully or partially) via an actuation force, the sprung ends 160 are disposed to be elastically spring biased such that the blade 150 is biased radially inward towards its retracted position (i.e., the blade is biased inward towards the tool body). Upon removal of the actuation force (via either partial or full retraction of the actuation module 180) the elastically spring biased sprung ends 160 cause the blade 150 to retract. Blade 150 is further preferably pre-biased towards the tool body 110 by sprung ends 160 when in the fully retracted position. Such pre-biasing provides for substantially full retraction of the blade 150 into recess 105 and further provides a retention force for holding the blade 150 securely to the tool body 110.

With continued reference to FIGS. 4A and 4B, exemplary embodiments of sprung ends 160 include elongated leg portions 161 and 169 located about a sprung hairpin portion 165. Leg portion 169 may be integral with the blade 150, for example, as shown on FIGS. 4A and 4B, or coupled thereto, for example, as described in more detail below with respect to FIGS. 6A and 6B. Upon actuation of actuation module 180, sprung ends 160 are opened against their elastic spring bias (i.e., leg portions 161 and 169 are opened against the bias of hairpin portion 165). Upon deactuation of actuation module 180, sprung ends 160 close with their elastic spring bias (i.e., leg portions 161 and 169 close about hairpin portion 165), thereby retracting the blade 150 radially inward towards the tool body.

It will be understood that while the invention is not limited to steering tool embodiments including hairpin sprung ends, hairpin configurations (for example as described herein with respect to FIGS. 4A and 4B and FIGS. 6A and 6B) tend to be advantageous for certain applications. Such hairpin configurations tend to be compact and may provide increased spring force as compared to other spring biased blade arrangements. As such, hairpin configurations may be particularly serviceable, for example, in small diameter tools (e.g., steering tools having an outer diameter of less than about 9 inches), where space is at a premium.

In the exemplary embodiment shown on FIGS. 4A and 4B, leg portions 161 of sprung ends 160 further include contact portions 162 that are deployed in floating contact with corresponding pin members 115. The pin members 115 are deployed in recess 105 and are integral with or mechanically connected to the tool body 110. Pin members 115 may include, for example, bolts, dowels, or other suitable equivalents, mechanically connected to the tool body in substantially any suitable manner. The pin members 115 are disposed to substantially restrain the contact portions 162 from moving radially outward relative to the tool body 110 during extension of the blades 150 (i.e., the pin members are disposed to constrain the second leg portion 161 from closing about hairpin portion 165). The floating contact with the pin members 115, while substantially restraining outward radial motion of the contact portions 162, allows the contact portions 162 to essentially pivot about the pin members 115. Such pivoting allows the contact portions 162 to both translate (slide) longitudinally relative to and rotate about the pin member 115 during extension and retraction of the blade 150.

Figure 4C:
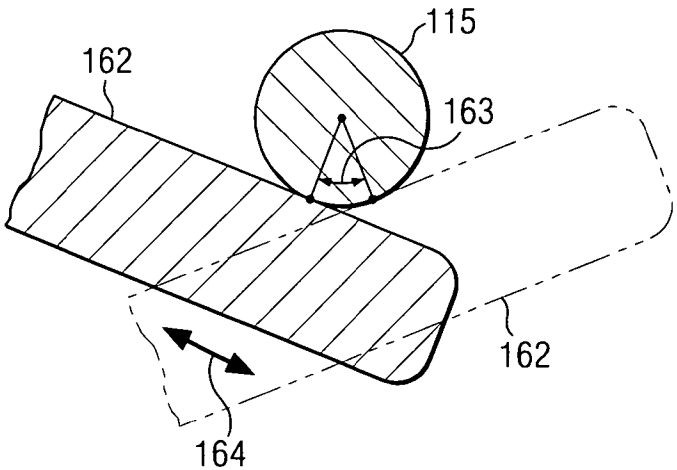
FIGS. 4A and 4B depict, in longitudinal cross section, a portion of one exemplary embodiment of the steering tool shown on FIG. 3 in which a blade is shown in fully retracted (FIG. 4A) and fully extended (FIG. 4B) positions.

With continued reference to FIGS. 4A and 4B, and further reference to FIG. 4C, the floating contact between contact portions 162 and pin members 115 is described in more detail. In FIG. 4C, the contact portion 162 of sprung end 160 is shown in solid lines when the blade is fully extended and dashed lines when the blade is fully retracted. In the exemplary embodiment shown, contact portion 162 both translates (substantially longitudinally as shown at 164) relative to the pin member 115 and rotates (as shown at 163) about the pin member 115 during extension and retraction of the blade 150. In the exemplary view shown on FIG. 4C, contact portion 162 translates right to left and rotates clockwise about the pin member 115 during extension of the blade and translates left to right and rotates counterclockwise about the pin member 115 during retraction of the blade. It will be understood that the motion of contact portion 162 described above is merely exemplary and not limiting of the invention in any way.

As described above, the floating contact advantageously enables the contact portions 162 of sprung ends 160 to essentially pivot about pin member 115 when the blade 150 is extended and retracted. Such pivoting motion (i.e., rotation and substantially longitudinal translation) advantageously tends to relieve stress in the sprung ends 160 in directions other than the radial direction, which substantially restrains the elastic spring biasing to the radial direction. In this manner, the stress relief provided by the floating contact substantially eliminates buckling and/or twisting of the sprung end 160, which advantageously improves controllability of blade 150 positioning and enables full radial extension and retraction of the blade 150 while minimizing unwanted lateral (longitudinal and tangential) motion or tilting (rotation) of the blade 150. Moreover, the stress relief also increases the range of radial extension of the blade, while simultaneously reducing the required actuation force.

It will be appreciated that consistent with the present invention, the blade 150 may be extended outward to substantially any displacement up to the yield point of the material of which the sprung ends 160 are fabricated. Embodiments of this invention may deploy and/or configure the actuation module 180 to prevent the blade from being overextended. For example, an actuation module having a limited range of motion may be utilized. Alternatively, the actuation module 180 may be sufficiently recessed in the tool body 100 to limit the degree to which it may extend the blade 150. The tool body 110 or the blade 150 may alternatively, and/or additionally include one or more constraining elements (e.g., tabs 154 shown on FIG. 5) that prevent overextension of the blade 150. Such constraining elements also advantageously tend to further secure the blades 150 to the tool body 110.

Figure 5:
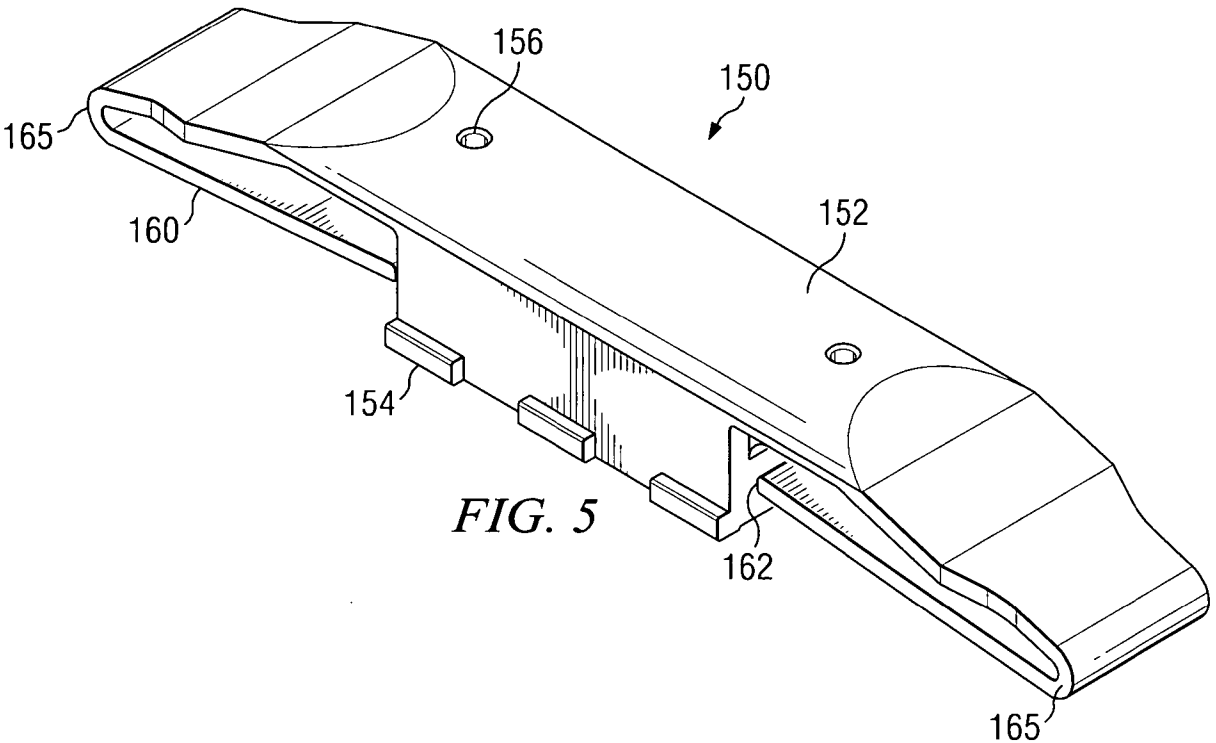
FIG. 5 depicts an exemplary blade embodiment of FIGS. 4A and 4B.

With reference now to FIG. 5, one exemplary embodiment of blade 150 is shown in perspective view. As described above, blade 150 includes integral sprung ends 160 including sprung portions 165 and contact portions 162. Exemplary blade embodiments 150, including integral sprung ends 160, may be advantageously fabricated from a spring steel, although the invention is not limited in this regard. Blade 150 further includes a contact surface 152 for contacting a borehole wall upon extension of the blade 150. In directional drilling applications, there may be relatively large forces (perhaps up to about 5 metric tons) exerted between the blade 150 and the borehole wall. Contact surface 152 may therefore advantageously include a wear resistant layer or material, such as a hard facing, a hardened weld layer, or a bolt on device. Contact surface 152 may also optionally include serrations, which may enable the blade 150 to grip the borehole wall more effectively. Although these aspects are not specifically illustrated, they are considered to be understood by those of skill in the art. In the exemplary embodiments shown, contact surface 152 further includes first and second access holes 156, through which the contact portions 162 of sprung ends 160 are urged behind pin members 115 (FIGS. 4A and 4B) during assembly of the tool.

Figure 6A:
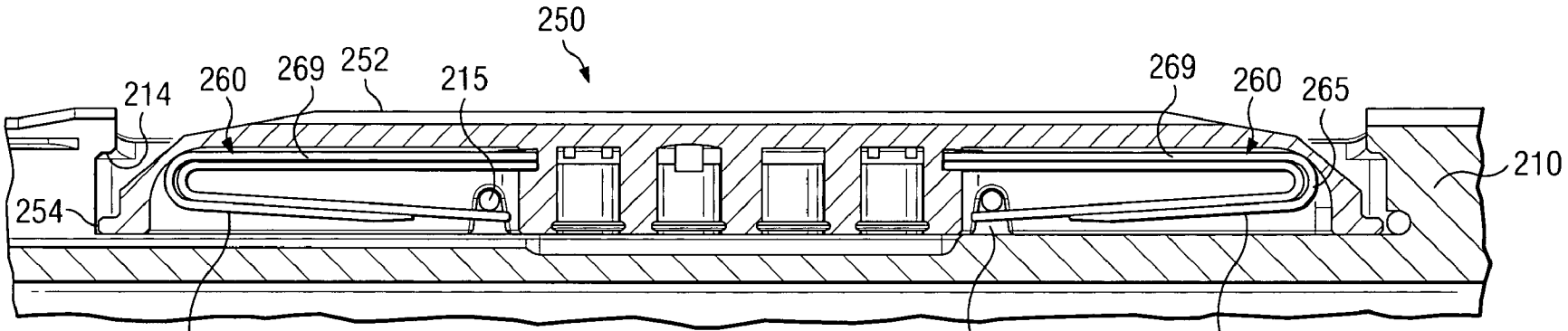
FIGS. 6A and 6B depict, in longitudinal cross section, a portion of another exemplary embodiment of the steering tool shown on FIG. 3 in which a blade is shown in fully retracted (FIG. 6A) and fully extended (FIG. 4B) positions.
Figure 6B:
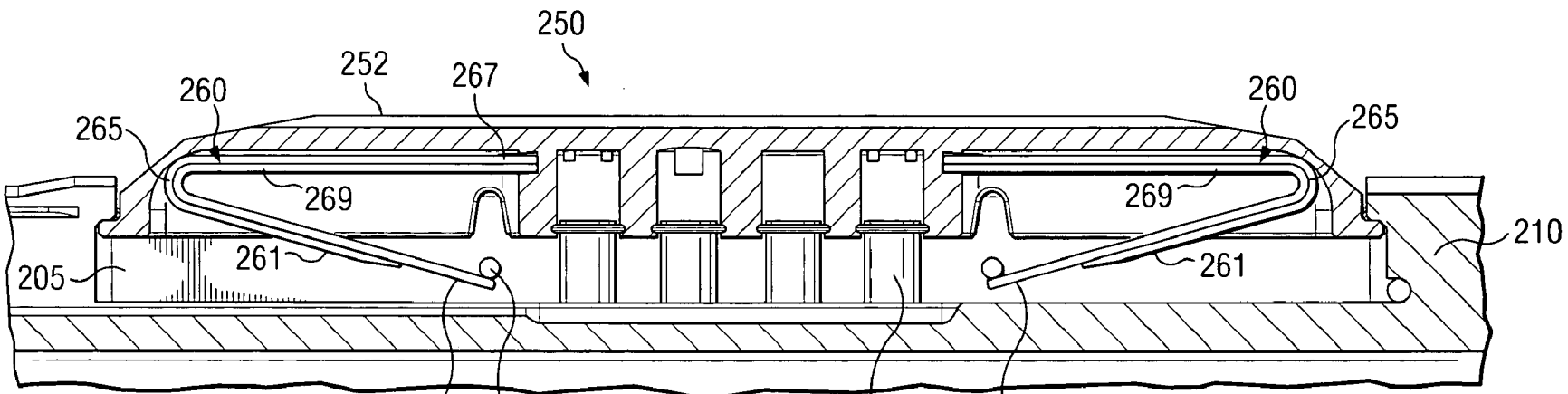

Turning now to FIGS. 6A and 6B, a portion of an alternative embodiment of a steering tool 200 according to the present invention is shown in longitudinal cross section with the blade 250 in fully retracted (FIG. 6A) and fully extended (FIG. 6B) positions. While shown only fully retracted and fully extended, it will be appreciated that the blade 250 may be may be partially extended in a controllable manner to substantially any position between the fully retracted and fully extended positions. Steering tool 200 is similar to steering tool 100 (shown on FIGS. 3 through 4B) in that blade 250 is deployed in recess 205 of tool body 210 and is configured to extend radially outward from the tool body 210 into contact with a borehole wall. Moreover, when blade 250 is extended (either fully or partially), it is elastically spring biased towards its retracted position. Upon removal of the actuation force (via either partial or full retraction of actuation module 280) blade 250 also retracts.

Blade 250 differs from blade 150 (FIGS. 4A and 4B) in that one or more spring-like sprung members 260 (e.g., including one or more leaf springs in the exemplary embodiment shown) are mechanically connected to the blade 250 at ends 267, rather than being integral therewith (as with blade 150). Sprung members 260 are similar to sprung ends 160 (FIGS. 4A and 4B) in that they include elongated leg portions 261 and 269 located about a sprung hairpin portion 265. Moreover, leg portions 261 further include contact portions 262 deployed in floating contact with pin members 215. In the exemplary embodiment shown, leg portions 269 are pinned to the underside of blade 250 (at ends 267), although the invention is expressly not limited in this regard. Sprung members 260 may be connected to blade 250 by substantially any other suitable technique, such as welding, brazing, riveting, bolting, screwing, and the like. Moreover, sprung members 260 are not necessarily connected to blade 250. Alternatively, they may contact the blade 250 at floating contacts (such as described above) that restrain ends 267 from radial motion relative to the blade 250. In such embodiments, ends 262 of sprung members 260 may be fixed (e.g., via bolting or some other suitable equivalent) to the tool body 210. Alternatively, each sprung member 260 may contact both the blade 250 and the tool body 210 at floating contacts. The invention is not limited in this regard.

Figure 7:
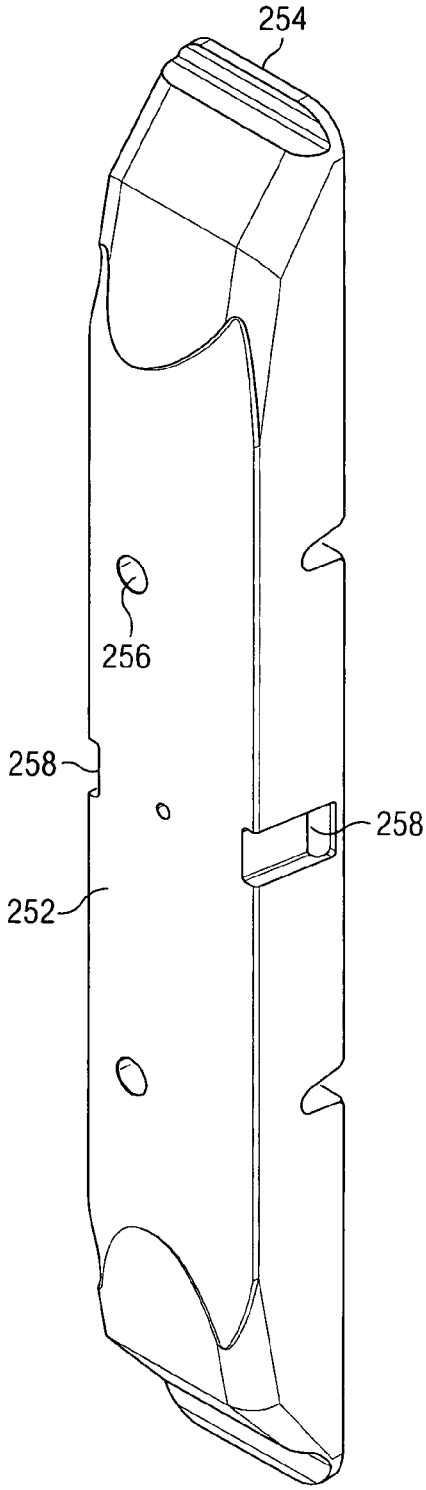
FIG. 7 depicts an exemplary blade embodiment of FIGS. 6A and 6B.

Turning now also to FIG. 7, one exemplary embodiment of blade 250 is described in more detail. In the exemplary embodiment shown, blade 250 includes first and second access holes 256 formed in contact surface 252 through which the contact portions 262 of sprung members 260 are urged behind pin members 215 during assembly of the tool. Access holes 256 may also be utilized to mechanically connect ends 267 of the sprung members 260 to the blade (e.g., via inserting a dowel or a bolt). Blade 250 further includes constraining members 254 formed on longitudinally opposed ends of the blade 250. Constraining members 254 are configured to contact a shoulder portion 214 of the tool body 210 and thereby limit blade 250 extension. Exemplary embodiments of blade 250 may also include constraining members 258 formed on the sides thereof.

Figure 8:
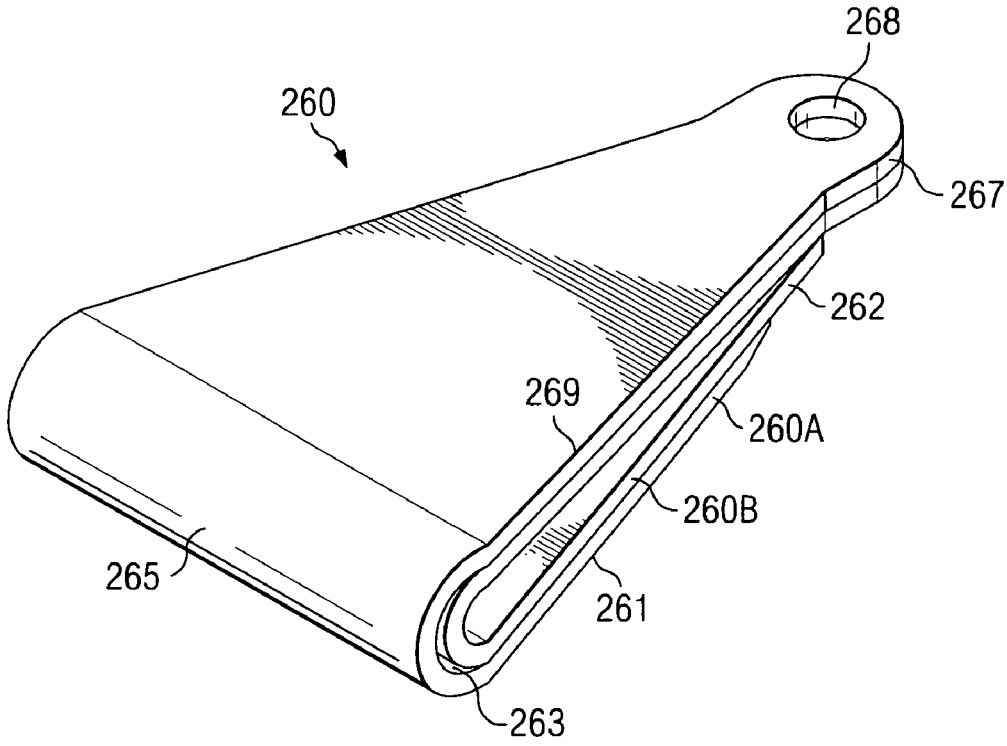
FIG. 8 depicts an exemplary spring embodiment of FIGS. 6A and 6B.

Turning now to FIG. 8, one exemplary embodiment of sprung member 260 is described in more detail. In the exemplary embodiment shown, sprung member 260 includes first and second leaf springs 260A and 260B. Leaf springs 260A and 260B may be fabricated, for example, from a spring steel and are typically welded at ends 262 and 267. Leaf springs 260A and 260B are sized and shaped such that sprung member 260 includes a gap 263 between leaf springs 260A and 260B at sprung portion 265 when the sprung member 260 is at rest (elastically unbiased). When sprung member 260 is opened against its bias (i.e., when leg portions 261 and 269 are opened as shown in FIG. 6B), leaf springs 260A and 260B slide relative to one another, such that gap 263 is closed when sprung member 260 is fully opened. In this manner stress is relieved in the sprung member during blade extension, which advantageously tends to further reduce buckling and/or twisting of the sprung member. Sprung member 260 also includes an access hole 268 in end 267 through which contact portion 262 is urged behind pin member 215 (FIGS. 6A and 6B) during assembly of the steering tool 200 as described above.

While the exemplary blade embodiments described and shown herein are elastically spring biased via first and second sprung members (or sprung ends), it will be appreciated that the invention is not limited to embodiments including two sprung members per blade. In certain embodiments a blade may be biased using a single sprung member. For example, the artisan of ordinary skill would be readily able to modify blade 150 to include, for example, one spring end and one hinged end. Alternatively, blade 250 might be modified to include a single spring like member connected to the underside of the blade. However, embodiments including first and second sprung ends (or sprung members) may be advantageous in certain applications in that they tend to provide better balance for the blade and thereby also tend to relieve the actuators from rotational stresses (torque). In still other embodiments three or more sprung members may be utilized to bias a blade towards the tool.

Although the present invention and its advantages have been described in detail, it should be understood that various changes, substitutions and alternations can be made herein without departing from the spirit and scope of the invention as defined by the appended claims.

We claim:

1. A downhole steering tool comprising:

a steering tool body having an outer surface;

at least one blade deployed in a recess on the outer surface of the tool body, the blade configured to displace between radially opposed retracted and extended positions;

at least one hairpin sprung member disposed to elastically spring bias the blade radially inward towards the retracted position, the hairpin sprung member including first and second leg portions located on opposing sides of a sprung hairpin portion, the first leg portion engaged with the blade, the second leg portion engaged with the tool body; and at least one actuation module disposed, upon actuation, to extend the blade radially outward from the tool body towards the extended position, said actuation disposed to open the hairpin sprung member against its elastic spring bias, the elastic spring bias disposed to close the hairpin sprung member and thereby retract the blade radially inward towards the retracted position upon deactuation of the actuation module.

2. The steering tool of claim 1, wherein the first leg portion of the hairpin sprung member is integral with the blade.

3. The steering tool of claim 1, wherein the first leg portion of the hairpin sprung member is mechanically connected to the blade.

4. The steering tool of claim 1, wherein a floating end of the second leg portion is in floating contact with the tool body, the floating contact substantially restraining the floating end from outward radial translation relative to the tool body.

5. The steering tool of claim 4, wherein the floating end is substantially free to pivot about a point on the tool body.

6. The steering tool of claim 1, comprising first and second hairpin sprung members located proximate to first and second longitudinally opposed ends of the blade, the first and second sprung members disposed to elastically spring bias the blade radially inward towards the retracted position.

7. The steering tool of claim 1, wherein the hairpin sprung member comprises first and second leaf springs mechanically connected to the blade, the leaf springs further mechanically connected to one another at one or more ends thereof, the leaf springs configured to slide relative to one another when the sprung member is opened against its bias.

8. The steering tool of claim 1, wherein the blade further comprises at least one constraining member disposed to engage the tool body when the blade is in the extended position.

9. A steering tool comprising:

a tool body having an outer surface;

at least one blade deployed in a recess on the outer surface of the tool body, the blade configured to displace between radially opposed retracted and extended positions;

the blade including first and second sprung ends, the sprung ends located proximate to first and second longitudinally opposed ends of the blade, the sprung ends disposed to elastically spring bias the blade radially inward towards the retracted position, each of the sprung ends in floating contact with the tool body, the floating contact substantially restraining a contact portion of the sprung end from translating radially outward relative to the tool body, the contact portion further substantially free to pivot about a portion of the tool body; and at least one actuation module disposed, upon actuation, to extend the blade radially outward from the tool body towards the extended position, said elastic spring bias disposed to retract the blade radially inward towards the retracted position upon deactuation of the actuation module.

10. The steering tool of claim 9, wherein the first and second sprung ends are integral with the blade.

11. The steering tool of claim 9, wherein the first and second sprung ends are mechanically coupled with the blade.

12. The steering tool of claim 9, wherein the contact portions of the sprung ends are in floating contact with corresponding pin members deployed on the tool body, the contact portions disposed to pivot about the pin members.

13. The steering tool of claim 9, wherein each of the sprung ends comprises first and second legs located on opposing sides of a sprung hairpin portion disposed to close the legs upon deactuation of the actuation module, said closing of the legs operative to retract the blade radially inwards towards the retracted position.

14. A downhole steering tool comprising:

a tool body having an outer surface;

at least one blade deployed in a recess on the outer surface of the tool body, the blade configured to displace between radially opposed retracted and extended positions;

at least one sprung member configured to elastically spring bias the blade radially inward towards the retracted position, the sprung member including at least one floating end, the floating end in floating contact with one of the blade and the tool body, the floating contact restraining the floating end from translating radially with its elastic spring bias relative to one of the blade and the tool body, the floating end substantially free to pivot about a portion of one of the blade and the tool body; and at least one actuation module disposed, upon actuation, to extend the blade radially outward from the tool body towards the extended position, said elastic spring bias disposed to retract the blade radially inward towards the retracted position upon deactuation of the actuation module.

15. The steering tool of claim 14, wherein:

the floating end is in floating contact with a pin member deployed on the tool body, the floating end substantially free to pivot about the pin member; and the sprung member further includes a fixed end, the fixed end being mechanically fixed to the blade.

16. The steering tool of claim 14, wherein the sprung member comprises first and second floating ends, the first floating end in floating contact with the blade, the second floating end in floating contact with the tool body.

17. The steering tool of claim 14, wherein the sprung end comprises first and second legs located on opposing sides of a sprung hairpin portion disposed to close the legs upon deactuation of the actuation module, said closing of the legs operative to retract the blade radially inwards towards the retracted position.

18. The steering tool of claim 14, comprising three blades, the blades being spaced equi-angularly about a periphery of the tool body, at least one sprung member elastically spring biasing each of the blades radially inwards towards the retracted position.

19. A downhole steering tool comprising:

a tool body having an outer surface;

at least one blade deployed in a recess on the outer surface of the tool body, the blade configured to displace between radially opposed retracted and extended positions;

at least one hairpin sprung member disposed to elastically spring bias the blade radially inward towards the retracted position, the sprung member including first and second leg portions located on opposing sides of a sprung hairpin portion, the first leg portion engaged with the blade, the second leg portion in floating contact with the tool body, the floating contact substantially restraining a contact portion of the second leg from translating radially outward relative to the tool body, the contact portion further substantially free to pivot about a portion of the tool body; and at least one actuation module disposed, upon actuation, to extend the blade radially outward from the tool body towards the extended position, said actuation opening the hairpin sprung member against its elastic spring bias, the elastic spring bias disposed to close the hairpin sprung member and thereby retract the blades radially inward towards the retracted position upon deactuation of the actuation module.

20. The steering tool of claim 19, further comprising:

a drive shaft deployed in the housing; and first, second, and third blades deployed substantially equi-angularly about a periphery of the housing.

21. A method for changing the drilling direction of a drill bit deployed in a subterranean borehole, the method comprising:

(a) deploying a drill string in the subterranean borehole, the drill string including a drill bit and a steering tool, the steering tool comprising:

a steering tool body having an outer surface;

at least one blade deployed in a recess on the outer surface of the tool body, the blade configured to displace between radially opposed retracted and extended positions;

at least one hairpin sprung member disposed to elastically spring bias the blade radially inward towards the retracted position, the hairpin sprung member including first and second leg portions located on opposing sides of a sprung hairpin portion, the first leg portion engaged with the blade, the second leg portion engaged with the tool body; and at least one actuation module disposed, upon actuation, to extend the blade radially outward from the tool body towards the extended position, said actuation disposed to open the hairpin sprung member against its elastic spring bias, the elastic spring bias disposed to close the hairpin sprung member and thereby retract the blade radially inward towards the retracted position upon deactuation of the actuation module;

(b) actuating the actuation module to extend the blade radially outward from the tool body into engagement with a wall of the subterranean borehole, the engagement with the wall displacing a longitudinal axis of the steering tool from a borehole axis, said displacement of the longitudinal axis changing an angle of approach of the drill bit; and (c) deactuating the actuation module so as to allow the elastic spring bias to urge the blade radially inwards towards the tool body, said urging of the blade radially inwards also changing the angle of approach of the drill bit.

* * * * *